United States Patent [19]

Fedder

[11] Patent Number: 5,046,960

[45] Date of Patent: Sep. 10, 1991

[54] HIGH DENSITY CONNECTOR SYSTEM

[75] Inventor: James L. Fedder, Etters, Pa.

[73] Assignee: AMP Incorporated, Harrisburg, Pa.

[21] Appl. No.: 630,716

[22] Filed: Dec. 20, 1990

[51] Int. Cl.[5] ..... H01R 13/658

[52] U.S. Cl. ..... 439/108; 439/608

[58] Field of Search ..... 439/108, 608, 609

[56] References Cited

U.S. PATENT DOCUMENTS

| | | | |
|---|---|---|---|
| 4,737,116 | 4/1988 | Slye et al. | 439/608 X |
| 4,966,557 | 10/1990 | Barkus et al. | 439/246 |
| 4,975,084 | 12/1990 | Fedder et al. | 439/608 |
| 4,984,992 | 1/1991 | Beamenderfer et al. | 439/108 |

*Primary Examiner*—Eugene F. Desmond

*Attorney, Agent, or Firm*—Katherine A. Nelson

[57] ABSTRACT

A high density, high frequency connector system 10 having first and second mating connector members 12, 70 each member including a multi-row array of signal contact member 52, 102 disposed in columns, each said signal contact member being secured in a respective passageway; a multi-row array of ground contact members 58, 110 disposed between the columns of signal contact members 52, 102 each of the ground contact members 52, 102 having at least a body section secured in a respective profiled slot 42, 94. Each profiled slot 42, 94 has a width selected to be greater than the thickness of the ground body section and means for maintaining the respective ground body sections centered within the respective otherwise wider slot to define air reservoirs of a controlled width on both sides of each ground contact member.

10 Claims, 9 Drawing Sheets

Fig. 7
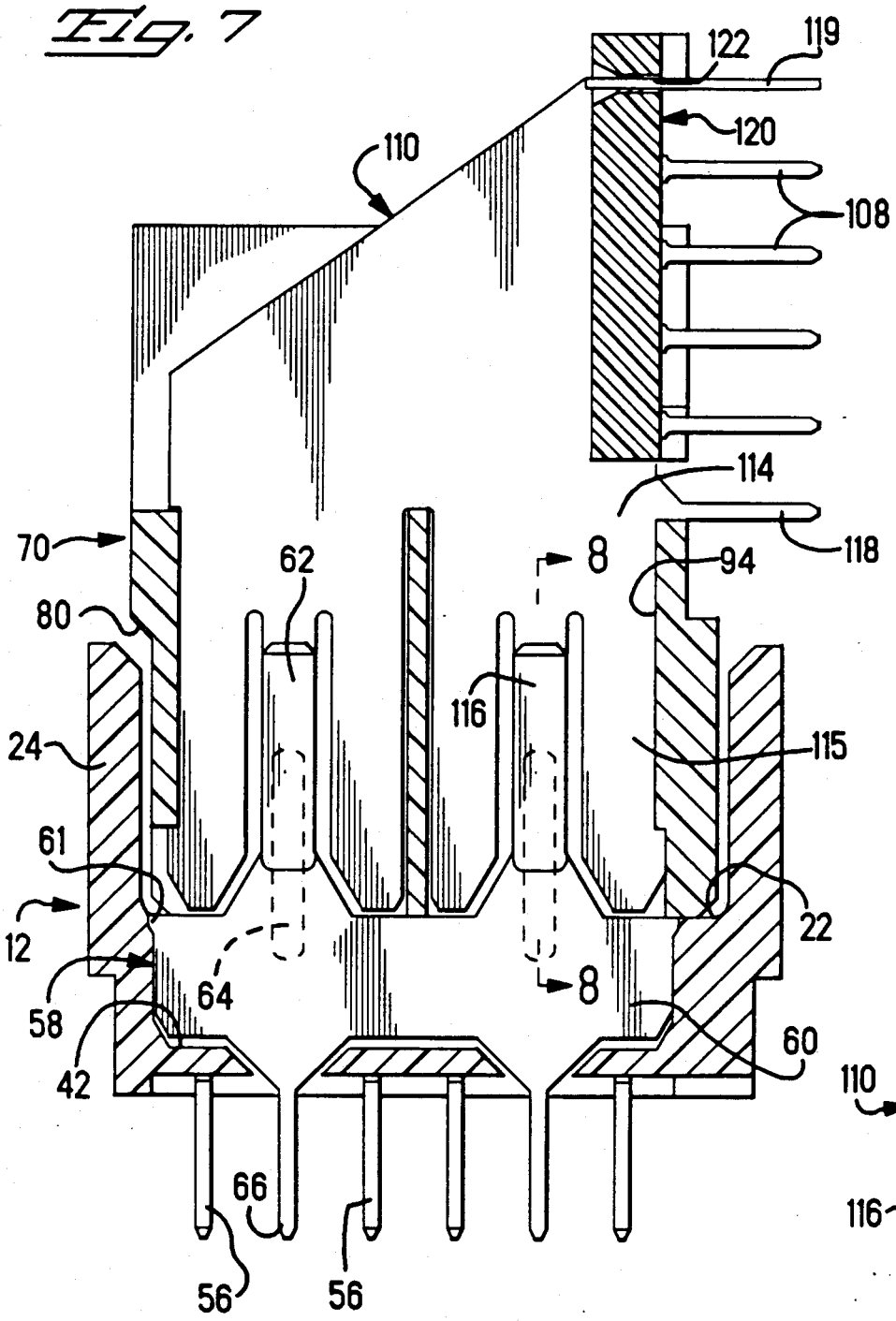
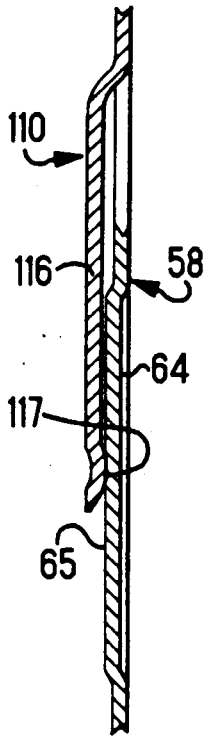
Fig. 8

HIGH DENSITY CONNECTOR SYSTEM

FIELD OF THE INVENTION

This invention is related to electrical connectors and more particularly to high density, high frequency electrical connectors for use in systems requiring impedance control.

BACKGROUND OF THE INVENTION

Modern electronics requires the use of high frequency and high speed connectors particularly for use in interconnecting circuitry on motherboards or backplanes and daughter cards or other circuit devices. These connectors require shielding or ground planes between the signal pins; e.g., stripline configuration, to provide high frequency signal integrity and minimize interference from outside sources. U.S. Pat. No. 4,975,084 discloses one such system provided with ground contacts between columns of signal contacts, the ground contacts of one connector having projecting blades and the mating ground contacts of the other connector including plates with cantilevered beams. The plates provide a shield between the columns of mated signal contacts and the cantilevered beams engage the blades to complete the ground circuits. The ground contacts of this connector are disposed within slots extending from the sidewall and partially across the respective housings and the connector includes an array of power, signal and ground contacts. This arrangement requires an amount of dielectric housing material to insulate between the adjacent contacts and to isolate the various circuits. For some applications, however, it is desirable to have a more highly dense array or grid of contact members, while maintaining the integrity between the lines. As the center line spacing between contact members in a row is decreased, the spacing between adjacent columns of contact members is likewise decreased, thereby necessarily reducing the amount of dielectric housing material between the members of the array. This in turn affects the electrical characteristics of the connector system and in particular reduces the impedance through the connector system. It is desirable, therefore, to have an electrical connector that provides a more dense array of contact members while maintaining the electrical characteristics associated with connectors having a less dense array of contact members.

SUMMARY OF THE INVENTION

Accordingly the present invention is directed to an improved high density, high frequency connector system that accommodates closer grid spacing of contact members while maintaining the desired electrical characteristics of a less dense array of contact members. The present invention is directed to a system for establishing an array of ground connections between first and second mating connectors of a connector assembly requiring impedance control. Each of the connectors of the assembly includes a housing having a multi-row array of signal contact members disposed in columns and secured in respective passageways of the housing, a multi-row array of ground contact members disposed in slots of the housing and extending between the columns of signal contact members and means for maintaining the respective ground contact members centered within an otherwise wider slot to define air reservoirs of a controlled width on both sides of each ground contact member. The signal contact members, therefore, may be closely spaced together thereby necessarily reducing the amount of dielectric connector structure between adjacent contact members in a row and concomitantly the columns of the array. The impedance of the connector assembly may be assuredly controlled by precisely defining the dimensions of the air reservoirs on each side of the ground contact member such that a desired proportion of dielectric material and air is achieved.

The invention is further directed to an electrical connector having ground contact or shield members secured in respective profiled slots between adjacent columns of signal contact members. The slots are selected to have a width greater than the thickness of the ground contact or shield member and include means for maintaining the ground contact or shield members centered within the otherwise wider slot to define air reservoirs of a controlled width on both sides of each ground contact member thereby permitting the signal contact members to be more closely spaced together in the connector while maintaining signal integrity and controlling the impedance through the connector.

It is an object of the invention to provide a high speed, high density connector system that maintains the electrical characteristics of a less dense connector system.

It is another object of the invention to provide a connector system having ground shields disposed between adjacent columns of signal members that are arranged in a close array.

The invention itself, together with further objects and attendant advantages will be best understood by reference to the following detailed description, taken in conjunction with the accompanying drawing.

BRIEF DESCRIPTION OF THE DRAWINGS

FIGS. 6 and 7 are cross-sectional views of the connector assembly of the invention illustrating the second contact members before and after mating the first and second connector members of FIGS. 2 and 5;

FIG. 8 is an enlarged fragmentary view taken along line 8—8 of FIG. 7, illustrating the interconnection between the ground contacts of the first and second connector members;

FIG. 13 is a sectional view of the mated connectors taken along line 13—13 of FIG. 10;

DETAILED DESCRIPTION OF THE DRAWINGS

Figure 1:
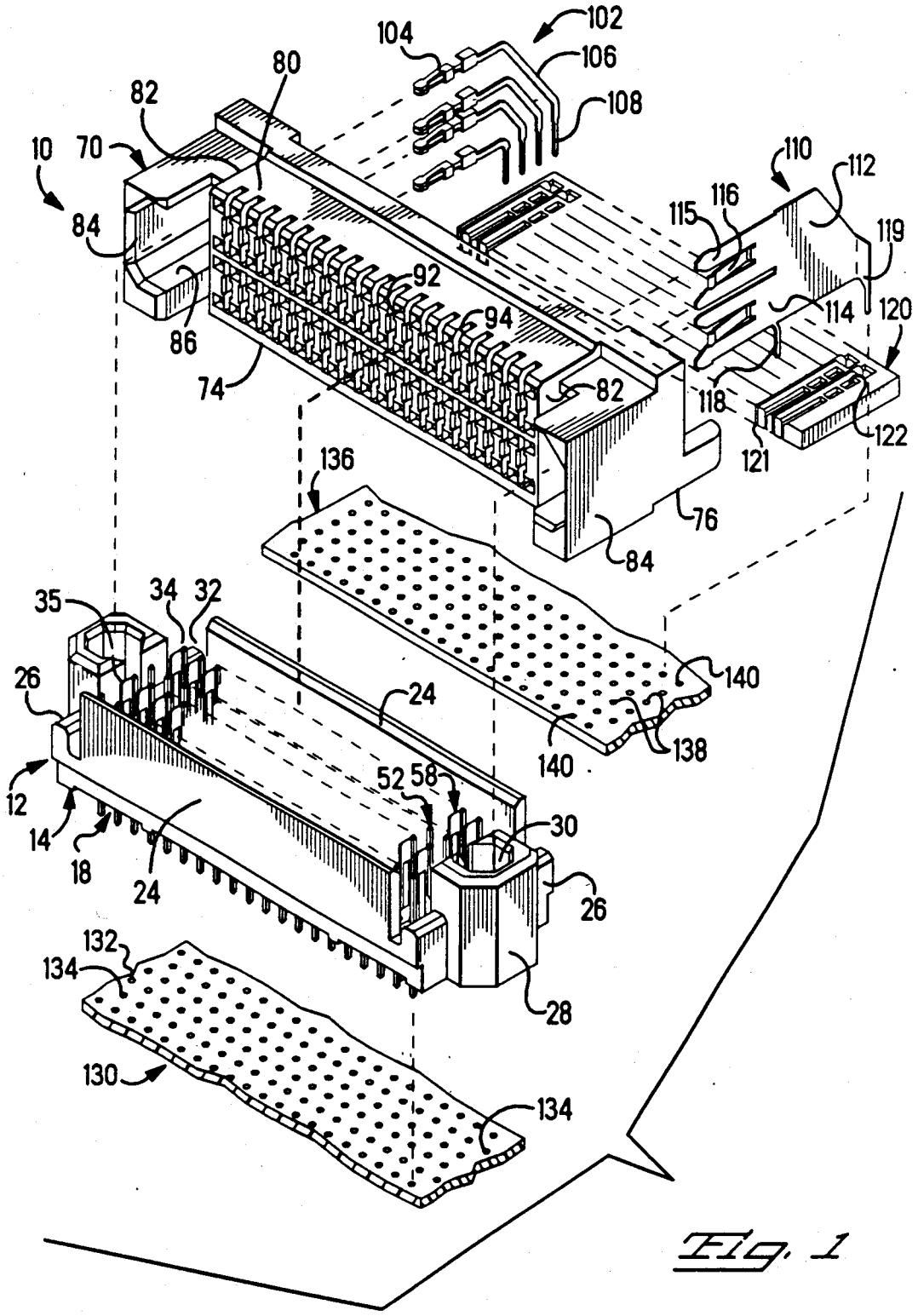
FIG. 1 is an exploded perspective view of the connector system of the present invention.

The electrical connecter system 10 of the present invention, as shown in FIG. 1, includes first and second matable connector members 12,70. The first connector member 12 is known in the art as a "pin header" and is shown exploded from a backplane or motherboard 130. The second connector member 70 is known as a "receptacle" and is shown exploded from a circuit board 136 typically called a daughter card. Each of the connector members 12,70 carry signal contact members 52,102 and ground contact members 58,110, respectively, which interconnect corresponding circuits on the daughter board 136 and backplane or motherboard 130. As shown in FIG. 1 the pattern for the apertures 132, 134 in the backplane 130 provide a uniform balance of the signal contact members to the ground contact members for improved electrical performance. A row of ground apertures 134 are disposed between first and second rows and between the third and fourth rows of signal apertures 132.

Figure 2:
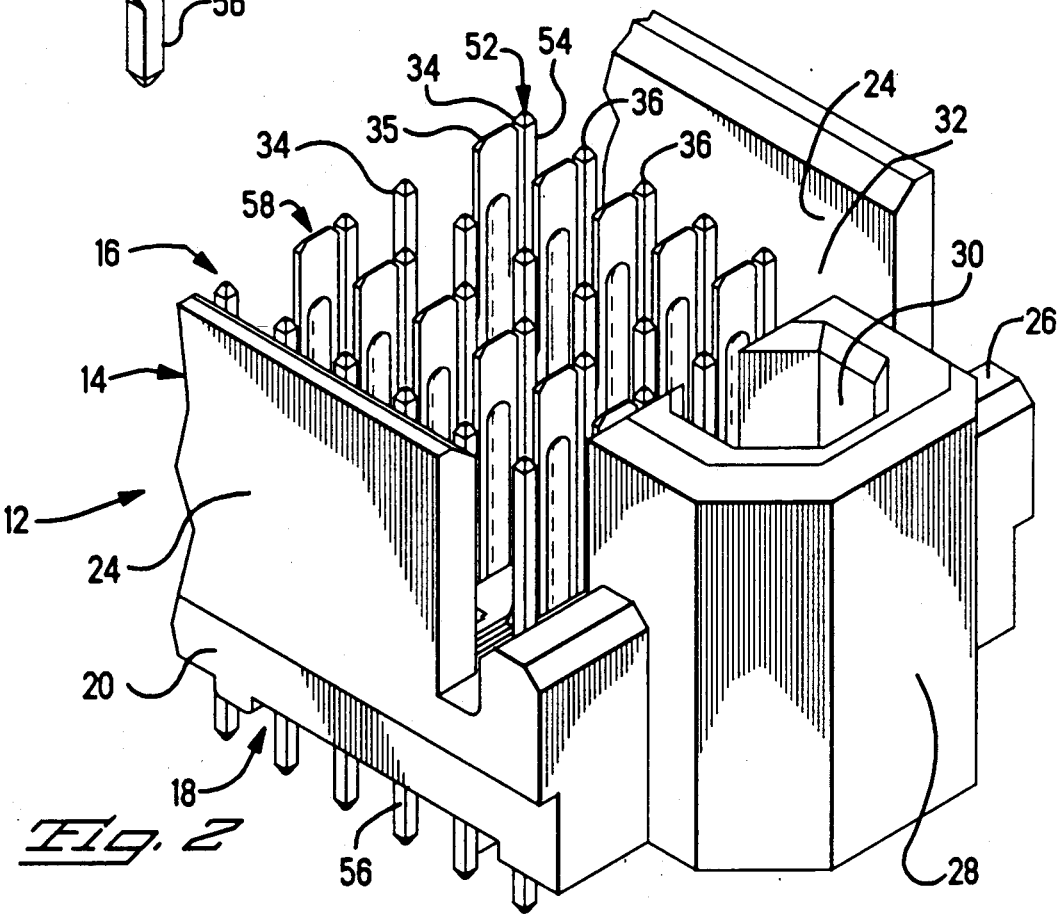
FIG. 2 is an enlarged fragmentary view of the first connector member of the system of FIG. 1.
Figure 9:
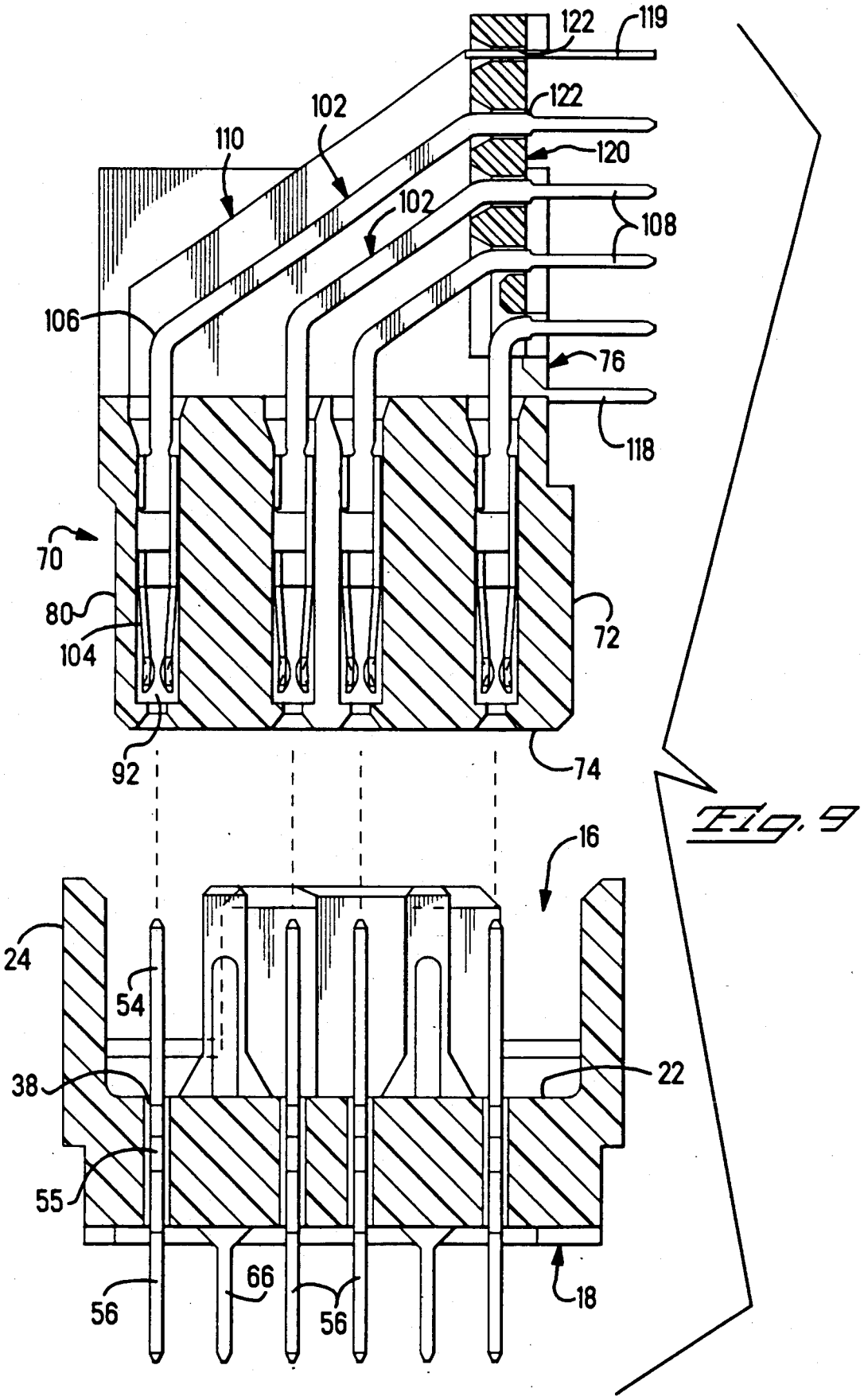
FIGS. 9 and 10 are cross-sectional views of the connector assembly of the invention illustrating the first contact members before and after mating the first and second connector members of FIGS. 2 and 5.
Figure 10:
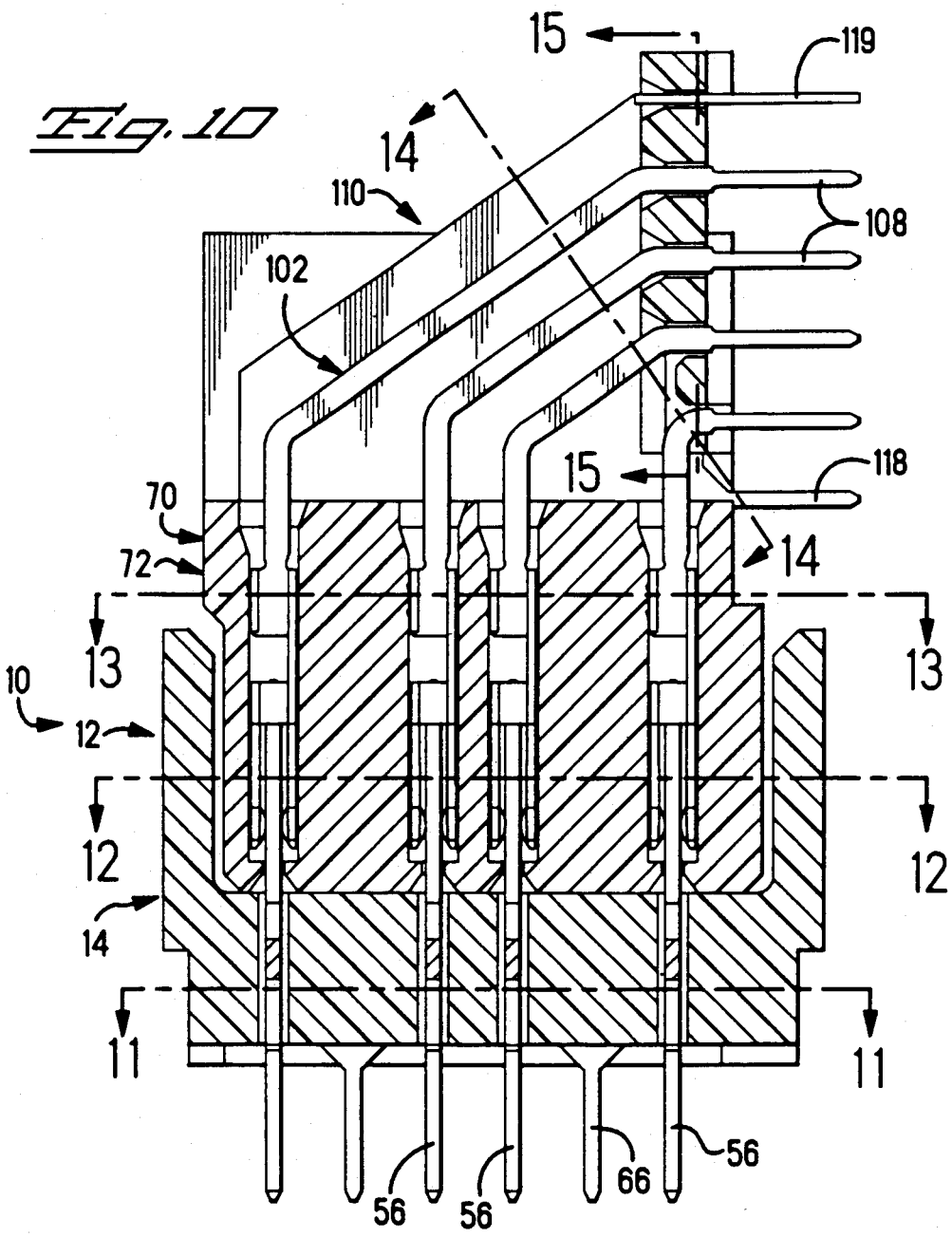

The structures of the mating connector members 12,70 are illustrated in FIGS. 1-5. First connector member or pin header 12 includes housing 14 having a mating face 16 and mounting face 18. Housing 14 includes a base 20, opposed side walls 24 and opposed end walls 26, which together define a cavity 32 in which are disposed the first and second contact members 52,58, respectively. As best seen in FIGS. 6 and 9, base 20 of housing 14 includes a plurality of passageways 38 extending therethrough from the mating face 16 to mounting face 18 for receiving the signal or first contact members 52 and a plurality of slots 42 for receiving the second or ground contact members 58. As shown in FIGS. 1 and 2, end walls 26 further include outwardly extending flanges 28 have apertures 30 extending therethrough for receiving securing means (not shown) as known in the art for mounting the first connector member or pin header 12 to the motherboard or backplane 132.

The first contact members 52 are disposed within the pin header 12 in orthogonal rows 34 and columns 36. A plurality of ground contact members 58 are disposed in rows 35 between selected rows of signal contact members. Each ground contact member 58 has a transverse body section 60 disposed within a respective slot 42 of the dielectric housing 14, the slots 42 being spaced between respective columns 36 of signal contact members 52.

Figure 3:
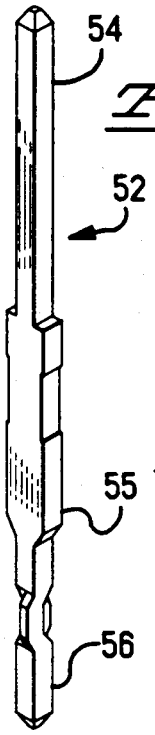
FIG. 3 is a perspective view of a first contact member used in the connector member of FIG. 2.
Figure 4A:
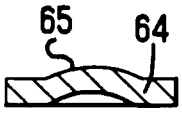
FIG. 4A is a cross sectional view of the second contact member taken along the line 4A—4A of FIG. 4.
Figure 4:
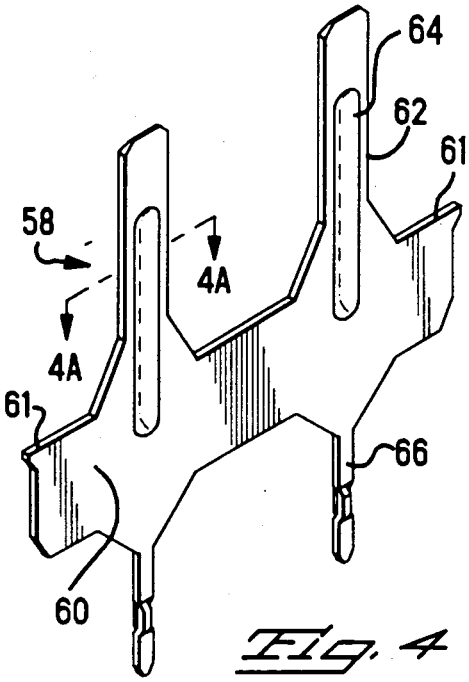
FIG. 4 is a perspective view of a second contact member used in the connector member in FIG. 2.
Figure 5:
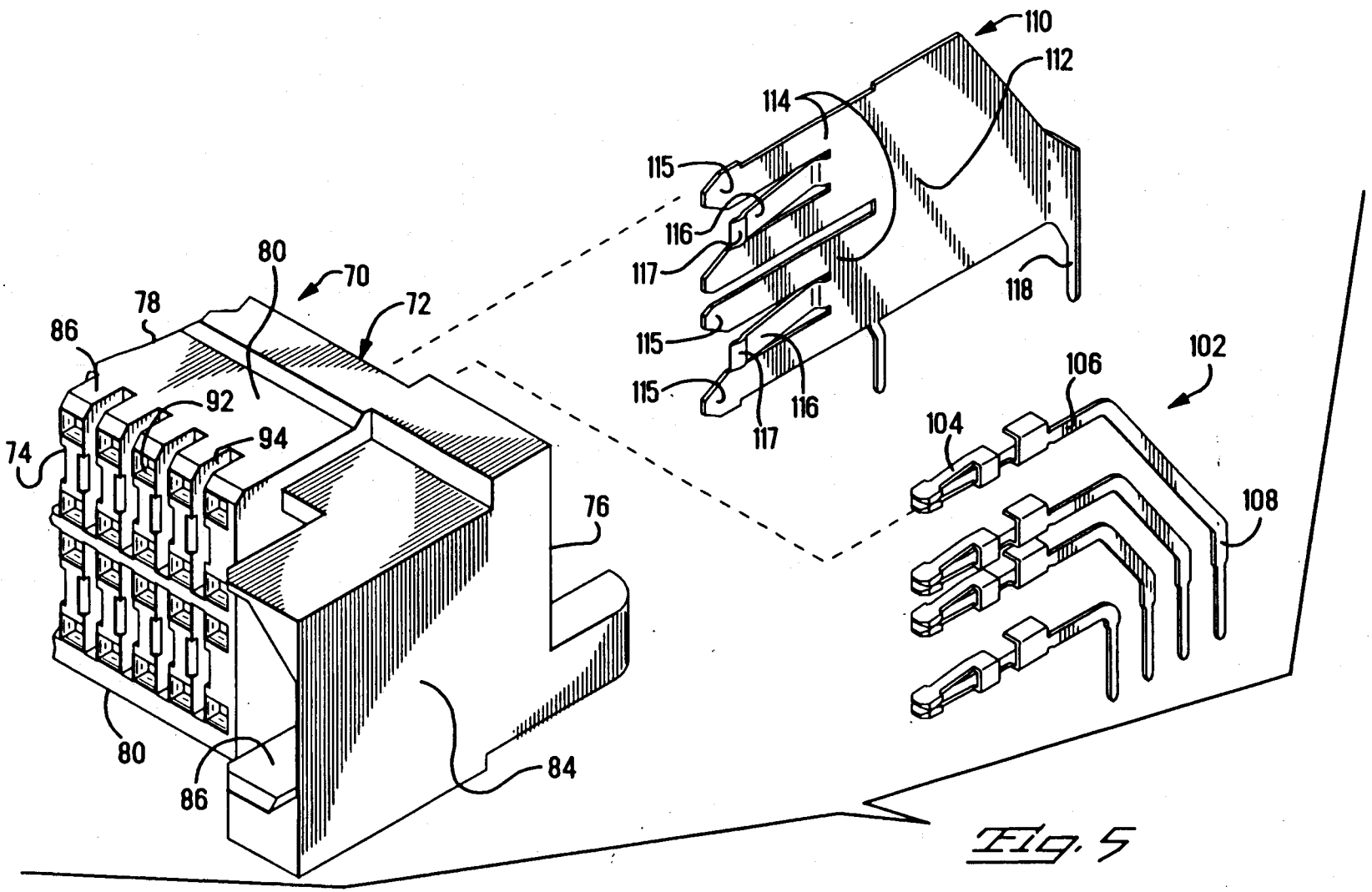
FIG. 5 is a fragmentary enlarged view of the second connector member of the system of FIG. 1 with the first and second contact members exploded therefrom.
Figure 6:
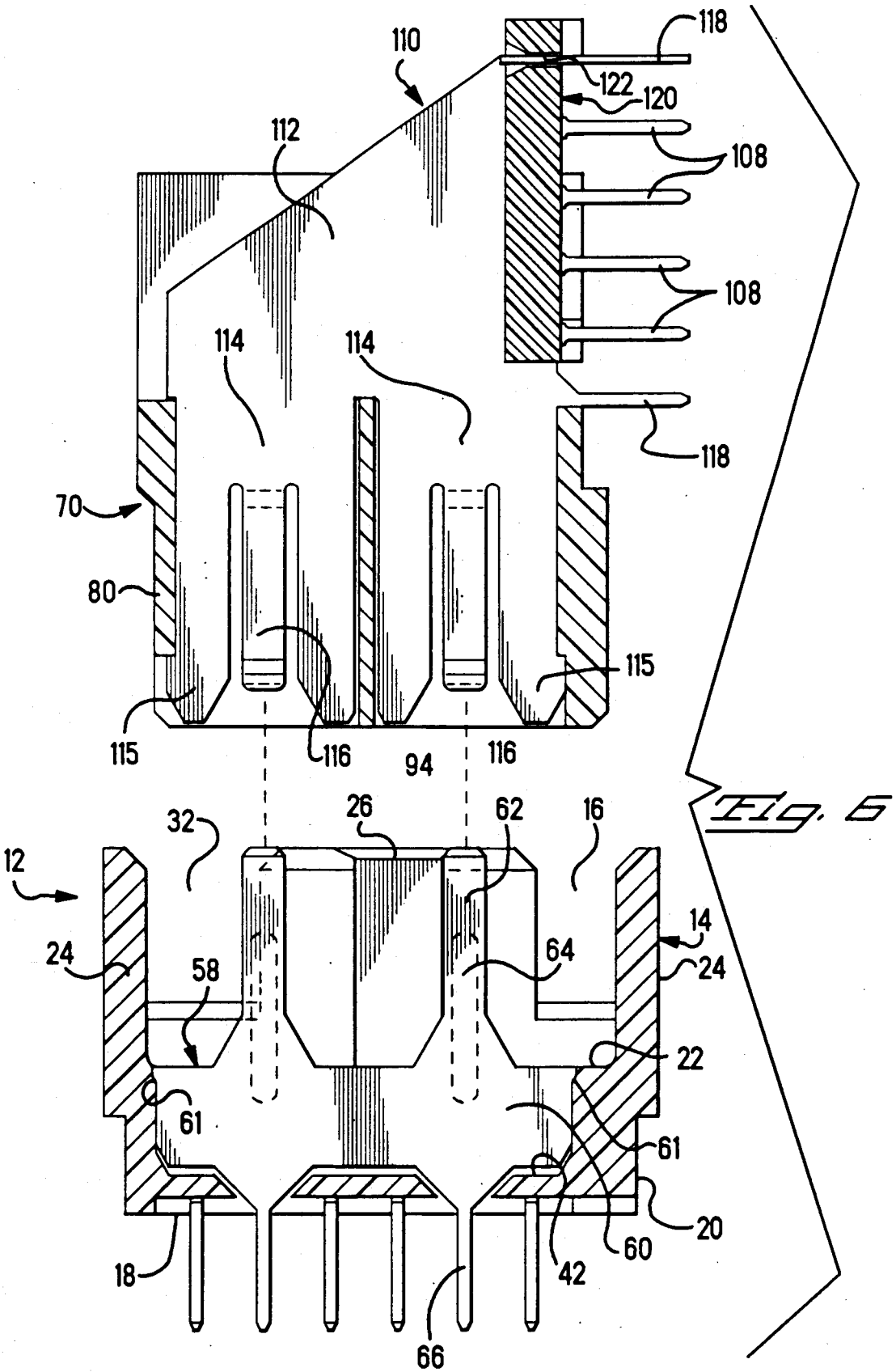

Referring now to FIGS. 3 through 5, each first or signal contact member 52 includes a first connecting portion 54, which extends into cavity 32 of the pin header 12; a second connecting portion 56, which extends below the mounting face 18 for engagement with a corresponding signal aperture 132 in circuit board 130; and intermediate portion 55 having means for securing contact member 52 in an interference fit within a respective passageway 38, as known in the art. The second or ground contact member 58 comprises a plate portion 60 having ears 61 extending thereto for securing in the housing as shown in FIG. 6 and includes a pair of upwardly extending first posts 62, each having a stiffening rib 64, and pair of downwardly directed lower posts 66 extending from the opposite edge of plate 60. The rib 64 is positioned on each first post 62 to provide reduced wear and improved durability during mating since the spring will be mating under a lower normal force and lower apparent interference stress due to prior engagement of the stiffening rib 64. The stiffening rib 64 has a radius designed to provide the higher final normal force and desired interface stress.

Figure 11:
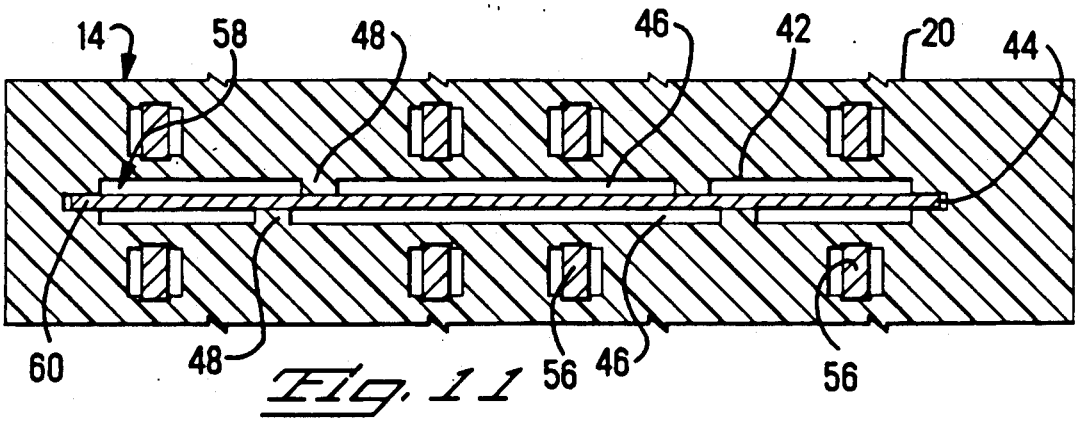
FIG. 11 is a sectional view taken along line 11—11 of FIG. 10.

As shown in FIGS. 6, 7 and in cross-section in FIG. 11, the ground contact member 58 is disposed in the housing 14 such that the plate 60 extends along the ground slot 42 and across the width of the first connector member 12. As best seen in FIG. 11 the ground slot 42 is configured to have end recess portions 44 for centering contact body section 60 and securingly engaging ground contact member 58 in position within housing base 20 in a snugly fitting relationship. Ground slot 42 is configured to provide air reservoirs 46 on opposed sides of ground plate portion 60. Tabs 48 extend into the air reservoirs 46 from opposed sides of slot 42 to precisely align the ground contact member 58 within the slot 42 and to control the size of the air reservoir defined thereby, the size of the reservoir being determined by the electrical characteristics desired and the geometry of the connector. Preferably tabs 48 are in staggered relationship to each other to reduce the resistance of the ground contact member as it is inserted into the housing slot 42. The offsetting thus compensates for incremental variations in thickness material that may occur during the fabrication of the contact members. For purposes of illustration, the second connecting portion 56 and lower posts 66 of the first and second contact members, 52, 58 respectively, are shown in FIGS. 3 and 4 with a compliant sections for holding the respective second connecting portions 56, 66 of contact members 52, 58 in the respective apertures 132, 134 in mother board 130. It is to be understood that solder tails and other configurations, as known in the art, may also be used. For purposes of illustration, the compliant sections have been omitted from the other figures. It is also to be understood that a contact member essentially identical to the ground contact member 58 may be used to carry power to the system. For safety reasons, the power contact member would have shorter length first posts 62 so that the ground contact members of the system would engage before the power contact members.

The structure of the second or receptacle connector 70 is shown in FIGS. 1, 5 and in cross-section in FIGS. 6 and 9. Receptacle 70 includes housing 72 having a mating face 74 and mounting face 76. Housing 72 includes body portion 78 having sides 80 and ends 82 having flanges 84 extending therefrom. Flanges 84 include portions 86 configured to receive the outwardly extending flanges 28 of pin header 12. As shown in FIGS. 6 and 9, receptacle housing 72 further includes a plurality of passageways 92 extending therethrough for receiving the first or signal contact members 102 and a plurality of ground slots 94 for receiving the second or ground contacts 110 therein. Referring again to FIGS. 1 and 5, each signal contact member 102 includes first connecting portion 104 for mating with a corresponding connecting portion 54 of signal contact member 52 in pin header 12, and second connecting portion 108 for being received into a respective aperture 138 in circuit board 136, the first and connecting portions being joined by intermediate portion 106. Each second ground contact member 110 includes a plate portion 112 having a forwardly extending blade portion 114 including two arm sections 115 and a spring member 116 disposed therebetween. Arm sections 115 include locking projections for securing ground contact member into housing cavity 94, as shown in FIGS. 6 and 7. The spring member 116 has a curved portion 117 for assuring int®rconnection with the corresponding ground post 64 of the pin header as discussed more fully below. The first and second receptacle contact members 102,110 are arranged in rows and columns that are complementary to those of mating connector member 12 such that respective signal and ground contact members of the first and second connector members 12,70 may be electrically interconnected.

Ground contact 110 further has second connecting portions or legs 118,119 for interconnecting to corresponding ground circuits 140 of daughter board 136. As shown in this embodiment, leg 119 extends downwardly from a rearward angled portion of plate 112, such that leg 119 enters a board aperture 140 that lies essentially in the same line as the column of signal apertures 138, as is best seen in FIG. 1. This arrangement of the signal and ground apertures on the daughter board facilitates the manufacture of the boards in that it makes more "hole free" board space available for circuit traces (not shown).

Figure 16:
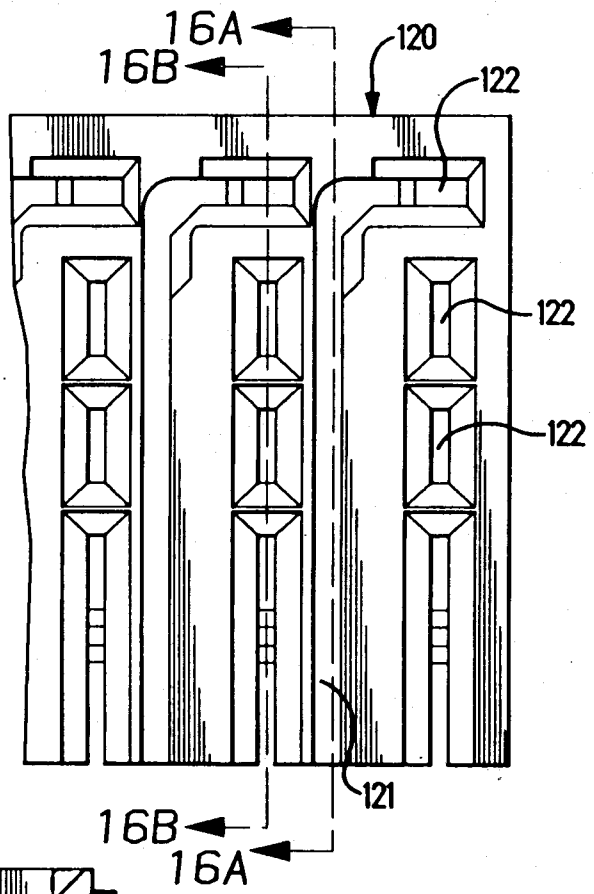
FIG. 16 is an enlarged fragmentary top plan view of the organizer plate of the connector member of FIG. 5.
Figure 16B:
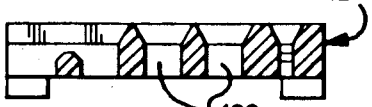
FIGS. 16A and 16B are cross-sectional views taken along lines 16A—16A, and 16B—16B of FIG. 16.
Figure 16A:
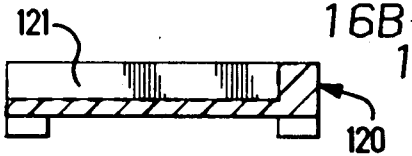

Receptacle member 70 further includes an organizer plate 120 as shown in FIG. 1 and in a fragmentary enlarged portion in FIG. 16. Plate 120 is also shown in cross-section in FIGS. 6 through 10. Plate 120 includes apertures 122 extending therethrough for receiving the second connecting portions 108 of signal contact members 108 and ground legs 118 and 119 of ground contact member 110. As more clearly seen in FIGS. 16, 16A, and 16B. plate 120 further includes a plurality of slots 121, which hold the edge of ground plate portion 112 in the desired position within receptacle 70. The organizer plate 120 is used to hold the second connecting portions 108; 118,119 of the receptacle contact members 102, 110 respectively in alignment for engagement with the corresponding apertures 138, 140 in daughter board 136 and to maintain the proper spacing between the ground contact member 110 and the signal contact members 102. For purposes of illustration, the organizer plate 120 has been omitted from FIG. 5.

As is shown in FIGS. 1, 2 and 5 the corresponding ground contact members 58, 110 are disposed between the columns of signal contact members 52, 102, to provide what is known as a stripline connector system. The ground contacts 58, 110 are disposed in slots 42,94 respectively that extend across the array of signal contact members 52, 102 to accurately maintain and control the unitary ground contact portion 60, 112 centered within a respective slot, the slot having a general width selected to be larger than the thickness of the ground member. Means are provided in both housing members to maintain the body of the ground section centered in the otherwise wider slot thereby defining air reservoirs on both sides of the ground member having a controlled width thereby providing a controlled impedance through the connector assembly.

Figure 14:
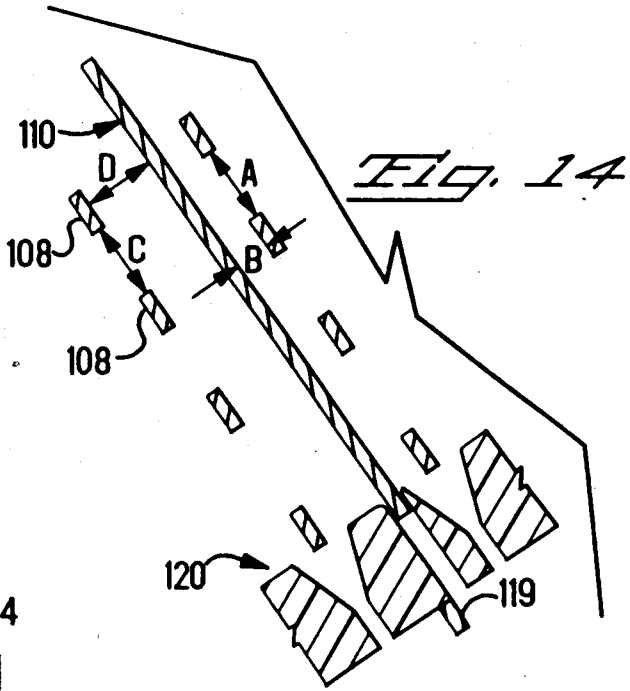
FIG. 14 is a sectional view taken along the line 14—14 of FIG. 10.
Figure 17:
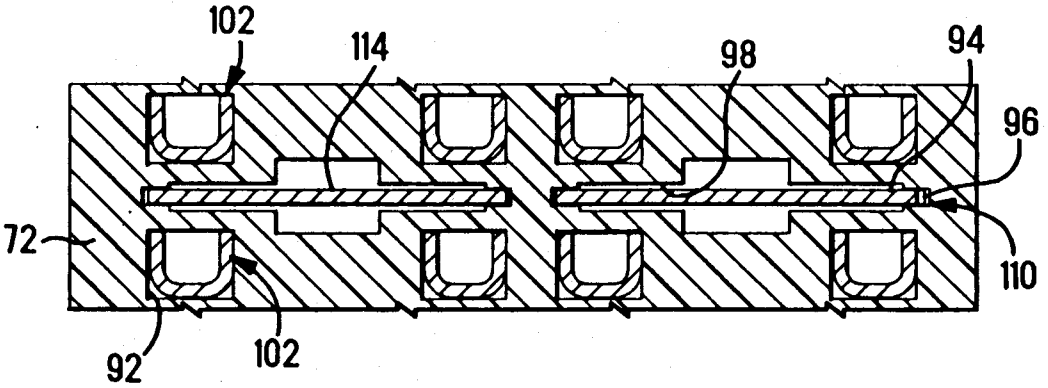
Figure 12:
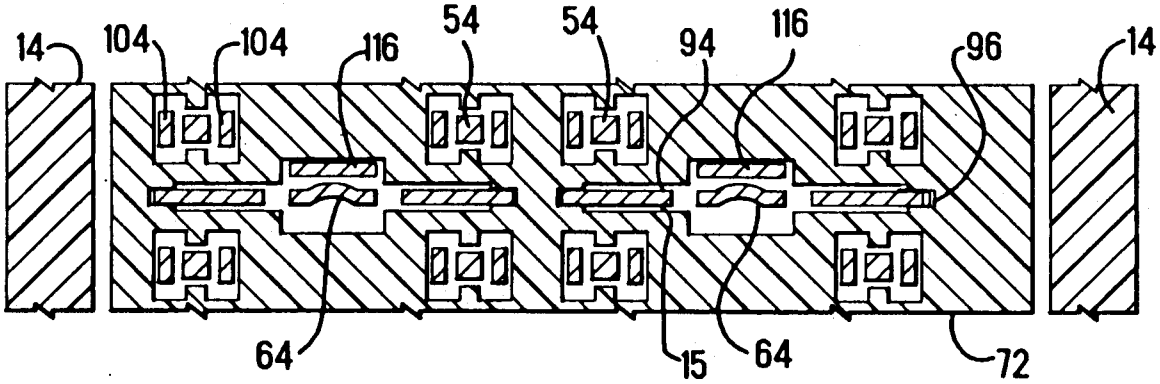
FIG. 12 is a sectional view of the mated connectors taken along line 12—12 of FIG. 10.
Figure 15:
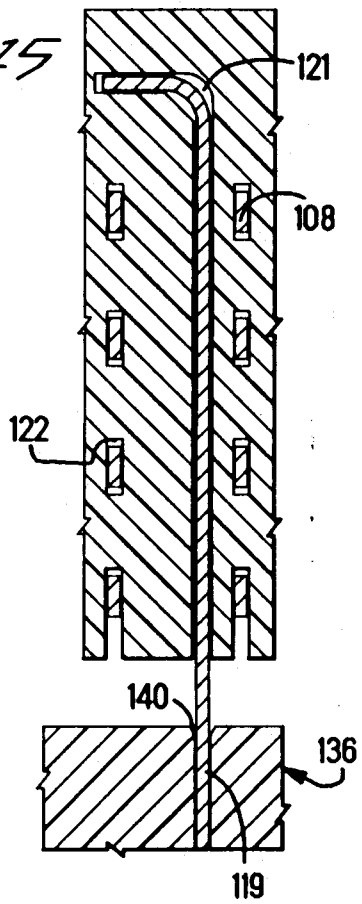
FIG. 15 is a sectional view taken along line 15—15 of FIG. 10.

The construction of the assembled connector system 10 of the present invention is shown in cross-section in FIGS. 6 through 10 and in assembled sections in FIGS. 11 through 15. FIGS. 6 and 7 illustrate the interconnection of the corresponding ground contact members 58, 110 wherein the curved portions 117 on spring members 116 of blade of the receptacle ground terminal 110 engage the surface 65 of rib 64 of the corresponding post 62 of pin header 12 as the connector members 12,70 are brought into mating engagement. This engagement is shown more clearly in FIG. 8. The curved surfaces provide assured electrical interconnection to complete the ground connections of this stripline connector system. This interconnection can also be seen in FIG. 12, which further illustrates the positioning of blades 114 within corresponding slots 94 such that arms 115 are securely held in position within slots 94 to provide the necessary air reservoirs between the blades 114 and the side of the slot 94 to achieve the desired electrical characteristics. As illustrated in FIGS. 14 and 15, the angled portion including leg 119 of plate 112 must also be secured in position between opposed rows of terminals 102 to assure the desired impedance characteristics of the connector are maintained. FIG. 14 further illustrates that the spacing A,C between adjacent signal contact tails 102 and the spacing B,D between angled portion 119 and the associated signal contacts 102 is maintained at the desired length to provide the desired impedance for the connector system.

The signal and ground contact members 52, 58 are inserted in the pin header from the mating face of the connector with the top of the ground contact member abutting the upper surface 22 of housing 14 as shown in FIG. 6. As shown in FIGS. 3 and 4, these contact members preferably have a compliant sections for securely locking in the corresponding apertures of the circuit board. It is to be understood that in the preferred embodiment all contact members would have this compliant section. The receptacle 70 is assembled by loading the signal and ground contact members into the respective passageways and slots 92, 94 from the rear of housing 72. Plate 120 is then placed over the ends of the contact members to retain them in the housing 72.

The high density connector system of the present invention is particularly suitable for metric packages such as applications requiring contact members spaced at two millimeter intervals. There is about a 27% increase in the signal pin density for a connector having the same number of rows of signal and ground contact members when the contact members are spaced at 2 mm (0.07 inches) intervals, rather than 2.54 mm (0.1 inches) intervals, which is typical spacing for currently available connectors.

It is thought that the high density connector system of the present invention and many of its attendant advantages will be understood form the foregoing description. It will be apparent that various changes may be made in the form, construction and arrangement of the parts thereof without departing from the spirit or scope of the invention or sacrificing all its material advantages. The form herein described is merely a preferred or exemplary embodiment thereof.

I claim:

1. A system for establishing an array of ground connections between first and second mating connectors of a connector assembly requiring impedance control, each of said first and second connectors of said assembly including:

a dielectric housing:

a multi-row array of signal contact members disposed in columns in said housing, each said signal contact member being secured in a respective passageway thereof;

a multi-row array of ground contact members disposed in said housing between said columns of signal contact members and between said rows of signal contact members, each of said ground contact members having at least a body section secured in a respective profiled slot, said slot having a width selected to be greater than the thickness of said ground body section; and means for maintaining said respective ground body sections centered within said respective otherwise wider slot to define air reservoirs of a controlled width on both sides of each said ground contact member, whereby the signal contact members may be closely spaced in the connector in a manner necessarily reducing the amount of dielectric housing structure between adjacent signal contact members in a row thereof, and the connector impedance assuredly controlled by precisely defined air reservoirs on each side of each ground contact member.

2. The system of claim 1 wherein said ground contact member has a unitary body section and said means for maintaining said ground body section within said slot comprises snugly fitting recesses portions at the ends thereof and a plurality of spaced oppositely facing first and second vertical ribs extending into said slot and against opposite sides of the ground body section.

3. The system of claim 1 wherein a transverse body section of said ground contact member is disposed in said respective slot such that said section intersects all rows of said signal contact members and is spaced between respective columns thereof.

4. The system of claim 1 wherein a transverse body section of said ground contact member is disposed in said respective slot such that said section intersects at least two of said plurality of rows of said signal contact members and is spaced between respective columns thereof.

5. The system of claim 1 wherein said ground contact member has a first transverse body section including a bifurcated portion having arms extending outwardly in the same plane as the body section, each of said arms being disposed in a respective slot that intersects at least two of said plurality of rows of said signal contact members and is spaced between respective columns thereof.

6. An improved electrical connector for use in a connector system requiring impedance control, the connector including a housing having a multi-row array of signal contact members disposed in columns thereof, each said signal contact member being secured in a respective passageway of said housing; a multi-row array of ground contact members disposed in respective slots within said housing, said ground contact members being positioned between said columns of signal contact members and between said rows of signal contact members, the improvement comprising:

each said ground contact receiving slot is profiled to receive at least a body section of said respective ground contact member, said slot having a width selected to be greater than the thickness of said ground body section; and means for maintaining said respective ground body section centered within said respective otherwise wider slot to define air reservoirs of a controlled width on both sides of each said ground contact member, whereby the signal contact members may be closely spaced in the connector in a manner necessarily reducing the amount of dielectric housing structure between adjacent signal contact members in a row thereof, and the connector impedance assuredly controlled by precisely defined air reservoirs on each side of each ground contact member.

7. The improved connector of claim 6 wherein said ground contact member has a unitary body section and said means for maintaining said ground body section within said slot comprises snugly fitting recess portions at the ends thereof and a plurality of spaced oppositely facing first and second vertical ribs extending into said slot and against opposite sides of the ground body section.

8. The improved connector of claim 6 wherein a transverse body section of said ground contact member is disposed in said respective slot such that said section intersects all rows of said signal contact members and is spaced between respective columns thereof.

9. The improved connector of claim 6 wherein a transverse body section of said ground contact member is disposed in said respective slot such that said section intersects at least two of said plurality of rows of said signal contact members and is spaced between respective columns thereof.

10. The improved connector of claim 6 wherein said ground contact member has a first transverse body section including a bifurcated portion having arms extending outwardly in the same plane as the body section, each of said arms being disposed in a respective slot that intersects at least two of said plurality of rows of said signal contact members and is spaced between respective columns thereof.

* * * * *